US012035775B1

(12) United States Patent
Leeper

(10) Patent No.: US 12,035,775 B1
(45) Date of Patent: Jul. 16, 2024

(54) HEAD WRAP AND ACCESSORIES

(71) Applicant: Charron A Leeper, Mayfield Heights, OH (US)

(72) Inventor: Charron A Leeper, Mayfield Heights, OH (US)

( * ) Notice: Subject to any disclaimer, the term of this patent is extended or adjusted under 35 U.S.C. 154(b) by 0 days.

(21) Appl. No.: 16/902,066

(22) Filed: Jun. 15, 2020

Related U.S. Application Data

(60) Provisional application No. 62/862,000, filed on Jun. 14, 2019.

(51) Int. Cl.
*A42B 1/041* (2021.01)

(52) U.S. Cl.
CPC ..... *A42B 1/041* (2013.01)

(58) Field of Classification Search
CPC ..... A42B 1/04; A42B 1/041; A42B 1/049; A42B 1/045; A42B 1/012; A42B 1/206; A42B 1/002; A42B 1/006; A42B 1/24; A42B 1/08; A42B 1/046; A42B 1/205; A42B 1/201; A47G 9/10; A47G 9/1045; A41D 27/26; A63B 71/10
USPC ..... 2/174, 202, 204, 207, 209.13, 268, 267, 2/173.5
See application file for complete search history.

(56) References Cited

U.S. PATENT DOCUMENTS 2,193,271 A * 3/1940 Cowherd ..... A42B 1/041 2/171
2,624,884 A * 1/1953 Degnon ..... A42B 1/045 2/207
2,696,007 A * 12/1954 Larkin ..... A42B 1/08 2/171
2,996,724 A * 8/1961 Rose ..... A42B 1/08 2/171
3,197,787 A * 8/1965 Toguan ..... A42B 1/08 2/171
3,237,209 A * 3/1966 Gettinger ..... A42B 1/041 2/171.04
3,249,948 A * 5/1966 Eppolito ..... A42B 1/241 2/195.7
3,327,330 A * 6/1967 McCullough ..... A47G 9/10 5/640
3,327,720 A * 6/1967 Carmony ..... A42B 1/049 132/274
3,556,115 A * 1/1971 Benson ..... A45D 8/40 132/274
3,618,140 A * 11/1971 Goldfarb ..... A42B 1/045 2/207
4,581,773 A * 4/1986 Cunnane ..... A42B 1/08 2/204
5,025,508 A * 6/1991 Duncan ..... A41D 23/00 D2/501

(Continued)

*Primary Examiner* — Amy Vanatta

(57) ABSTRACT

A head wrap where a portion of fabric or material has the shape of an irregular pentagon. Three corners have 90 degree angles, and 2 corners have 45 degree angles, and the 2 opposite 90 degree angle corners are slightly overlapped and secured together to form a tube shape. The head wrap includes a grip strip or elastic band placed to reduce slippage of the wrap from a position at the back of a wearer's head near the neck. When needed or desired, an accessory pillow of fabric material which is filled with polyester fiber, is used for stuffing inside a volume formed within the head wrap to enable an up-style appearance when wearing the head wrap.

7 Claims, 5 Drawing Sheets

(56) References Cited

U.S. PATENT DOCUMENTS

| | | | | |
|---|---|---|---|---|
| 5,048,542 | A * | 9/1991 | Murray | A61F 15/004 128/889 |
| 5,058,211 | A * | 10/1991 | Hanks | A41D 23/00 2/206 |
| 5,659,911 | A * | 8/1997 | Kirkbride | A47G 9/10 428/401 |
| 6,189,151 | B1 * | 2/2001 | Curtis | A45D 44/12 132/202 |
| 6,247,181 | B1 * | 6/2001 | Hirsch | A42B 1/041 2/171 |
| 6,397,399 | B1 * | 6/2002 | Lampe | A63B 71/10 2/171.2 |
| 7,117,544 | B2 | 10/2006 | Kanitz | |
| 9,167,921 | B2 * | 10/2015 | Rieber | B60N 2/2851 |
| D770,144 | S | 11/2016 | Lumpkin-Loving | |
| 2007/0199151 | A1 * | 8/2007 | Brown | A61F 5/3707 5/655 |
| 2009/0293177 | A1 * | 12/2009 | Adkins | A42B 1/041 2/171 |
| 2011/0247126 | A1 * | 10/2011 | White | A42B 1/041 2/207 |
| 2016/0302500 | A1 * | 10/2016 | Johnston | A42B 3/00 |

* cited by examiner

HEAD WRAP AND ACCESSORIES

CROSS REFERENCE TO RELATED APPLICATION

The present application claims priority from U.S. Patent Application Ser. No. 62/862,000 filed Jun. 14, 2019, the entirety of which is incorporated herein by reference.

FIELD OF INVENTION

The present invention relates generally to an apparatus for a head wrap, and specifically to a head wrap that folds in multiple formats and with accessory stuffing material and anti-slippage for creating an assortment of styles.

BACKGROUND

Most head wraps cover or surround the user's head, but are only provided in one style or appearance. There is a need for a head wrap that enables creation of multiple styles of headbands or full wraps. The present application provides an apparatus that forms a headband or full wrap that folds in multiple arrangements, and with additional anti-slippage and stuffing features, to provide an assortment of styles for the user.

SUMMARY

Applicant's wrap is to be worn as a head cover or hair fashion accessory. The wrap may be provided in various stretch fabrics, and may be lined with additional fabrics, such as satin materials. The wrap provides a sewn piece of cloth that enables the user to transition the head wrap cover from being worn at night, in order to preserve curls while sleeping, to being worn as a fashion accessory during the day or in the evening. Additionally, the use of the head wrap retains moisture in the hair, to help keep the hair from drying out.

In another embodiment, where the wrap has extra fabric material due to a lack of volume in the wearer's hair, an accessory such as a sewn "puff" or small fabric pillow filled with stuffing or fiber stuffing, may also be used. The head wrap is "stuffed," placed or filled at the top with the puff into the empty space or area of the wrap, giving the wearer an up-style appearance.

Still further, Applicant's alternate embodiment of a wrap includes a strip accessory of gripping material, or a band of elastic sewn into a back hem, both of which enable less slippage of the wrap at the back of the user's neck. The gripping elastic maintains the wrap in position on the wearer's head.

DETAILED DESCRIPTION

Figure 1:
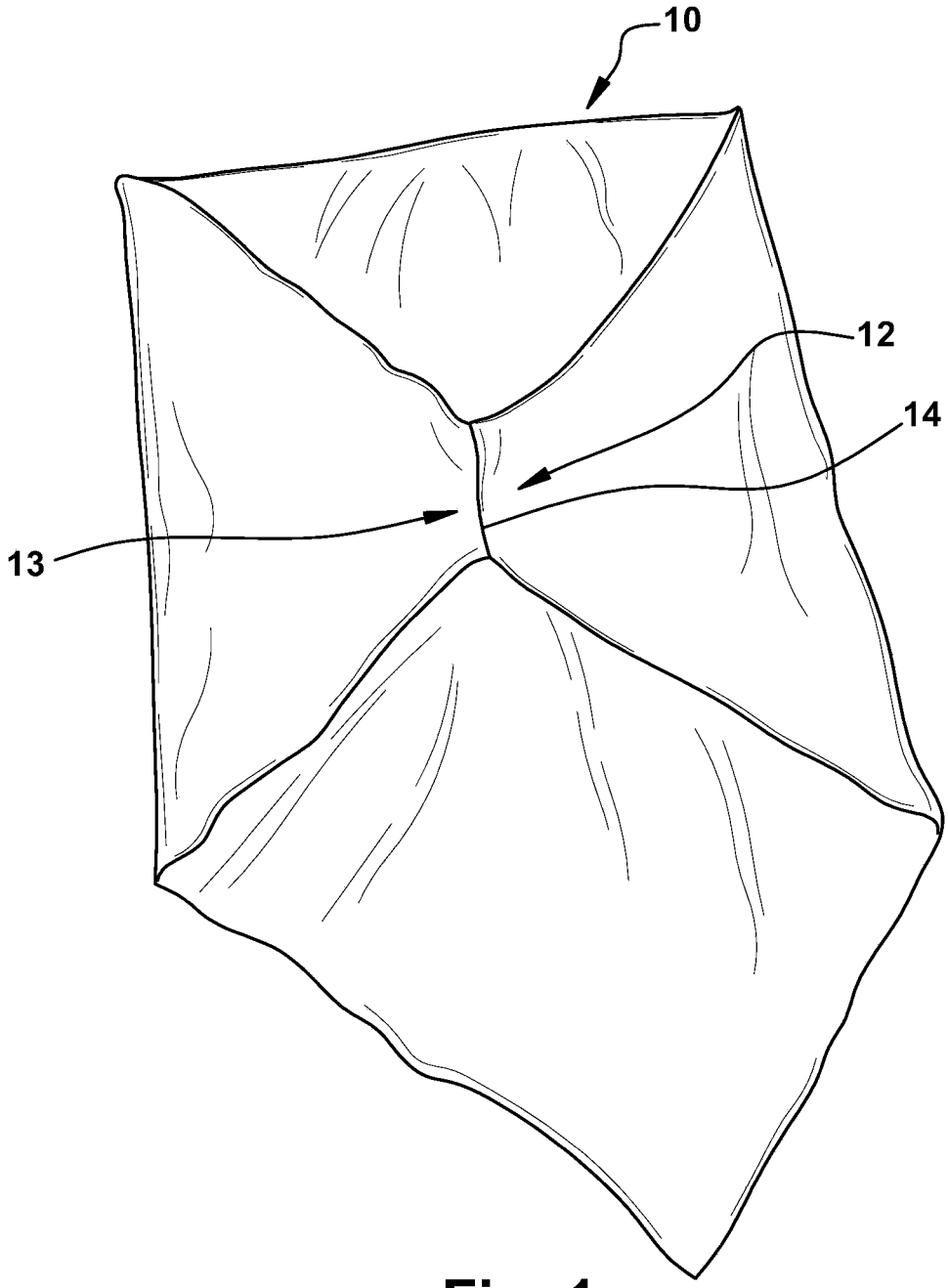
FIG. 1 illustrates the inner shape and construction of the head wrap with opposite 90 degree angled corners overlapped and secured together to form a tube shape.
Figure 2:
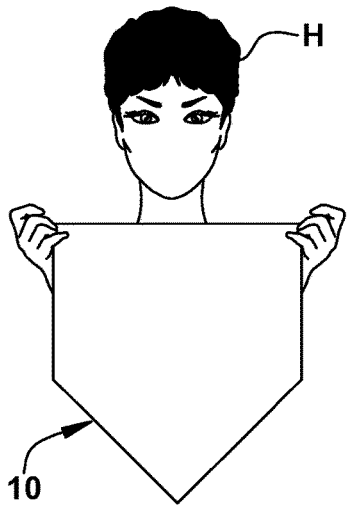
FIGS. 2 to 8B illustrate additional incremental steps for holding, folding and wrapping steps to ultimately present the wrap in either the full wrap appearance of FIG. 7, or the headband appearance of FIGS. 8A and 8B.

As shown in a folded and sewn view in FIG. 1, the "perfect pineapple" wrap 10 is an irregular convex pentagon shape, where the two opposite corners 12, 13 of the pentagon having a 90 degree angle, are overlapped and sewn together 14. By sewing the corners 12, 13 so that they are secured in an overlapping position, the wrap 10 becomes a tube shaped band (somewhat similar in appearance to a cannoli Italian pastry), which appears as a closed tube and may then be manipulated as indicated, however, nothing in the figures and description is intended to limit the scope of this application.

Figure 7:
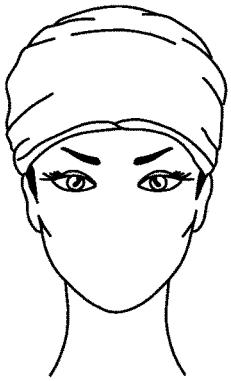
Figure 8A:
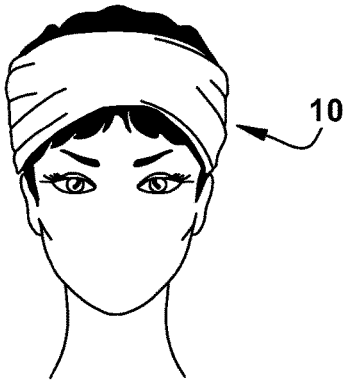
Figure 8B:
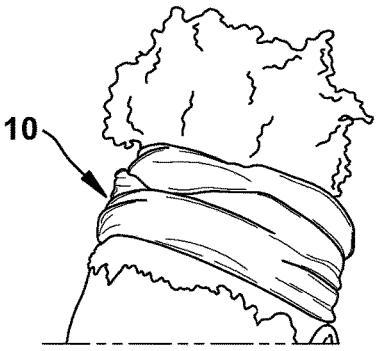
Figure 9A:
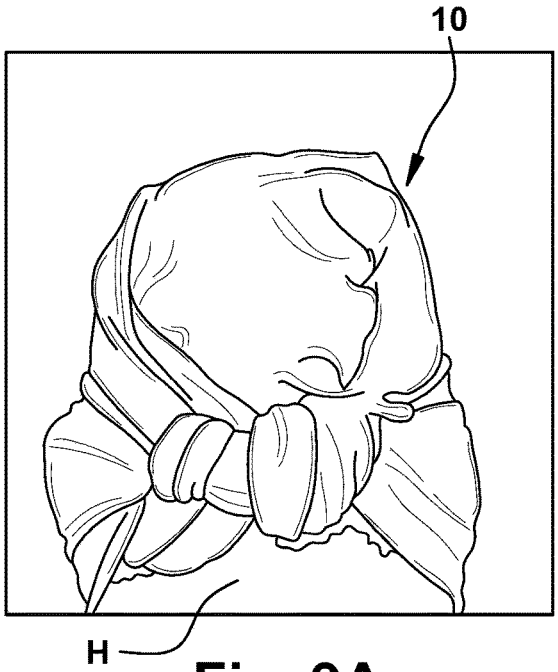
FIGS. 9A and 9B show the headband wrap in an alternative top bun, which may also be considered a turban style, where the hair is worn down and flowing outward from the bottom of the back of the turban styled wrap.
Figure 9B:
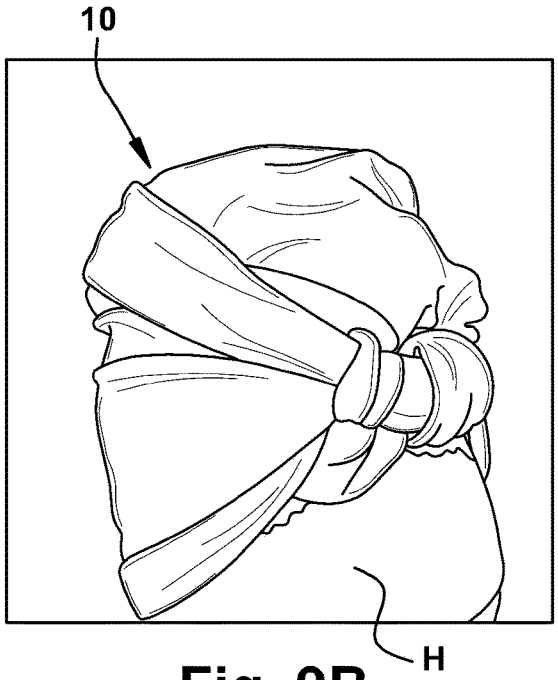
Figure 10:
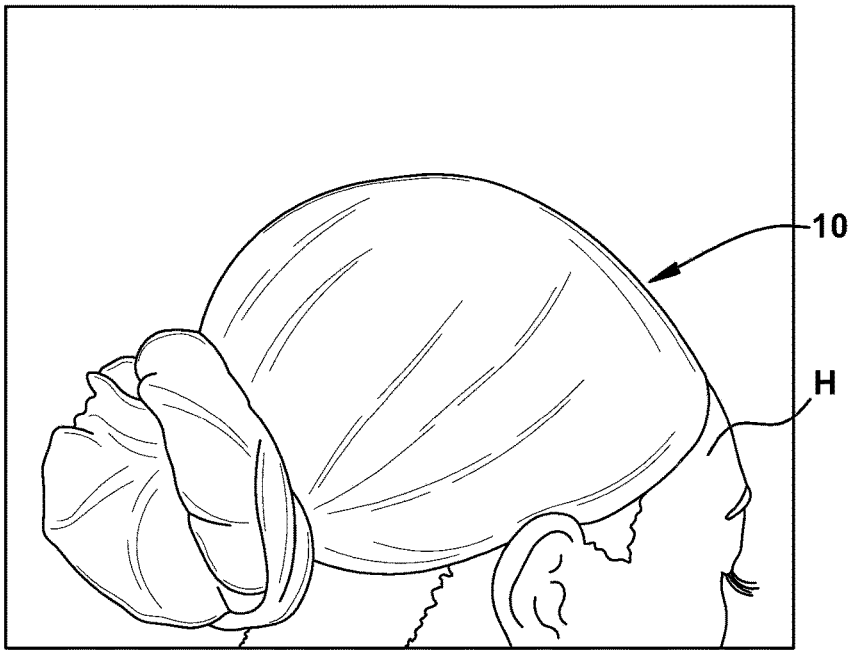
FIG. 10 shows the head wrap in a back bun style.
Figure 11:
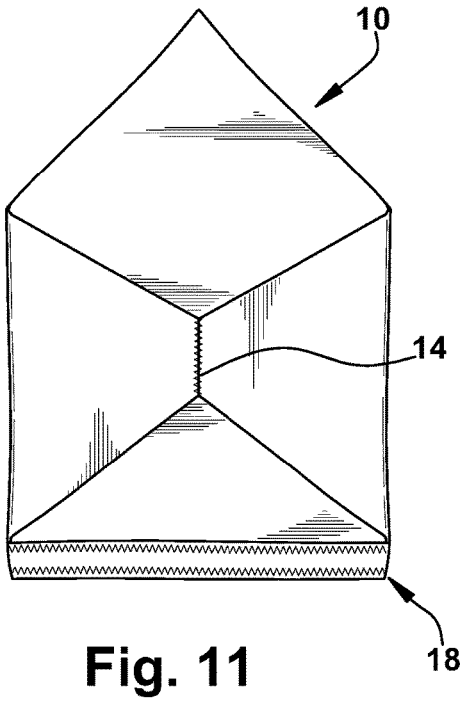
FIG. 11 illustrates an alternate embodiment of the head wrap of FIG. 1, where the inner shape and construction of the wrap additionally includes an elastic band or grip strip formed at the bottom of the wrap in the location shown, for engagement with the back of the user's head near the neck.
Figure 12:
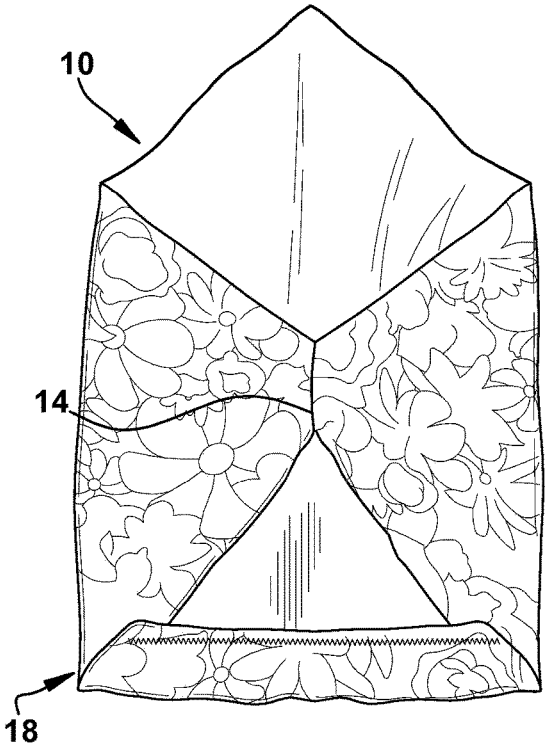
FIG. 12 demonstrates the alternate embodiment of the head wrap of FIG. 11.
Figure 14:
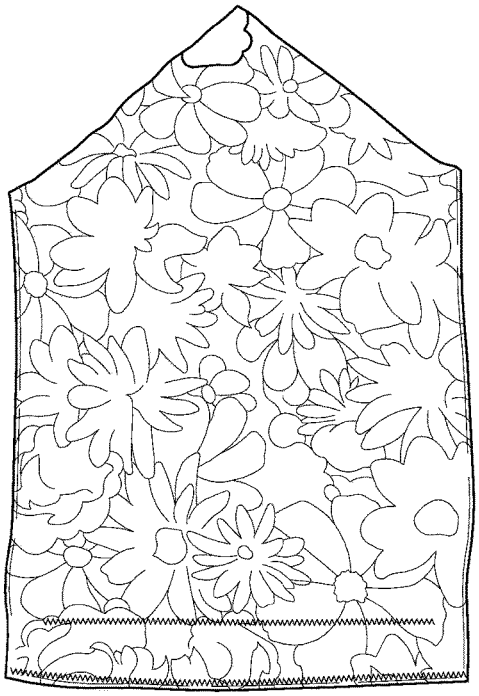
FIG. 14 shows the outer shape and construction of the head wrap of FIGS. 11 and 12.
Figure 13:
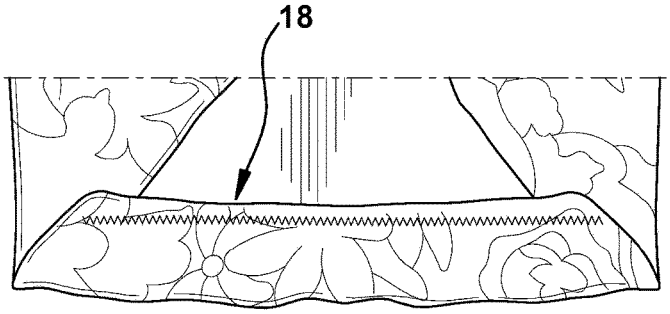
FIG. 13 shows an enlarged schematic view of the elastic band or grip strip formed at the bottom of the wrap.
Figure 15:
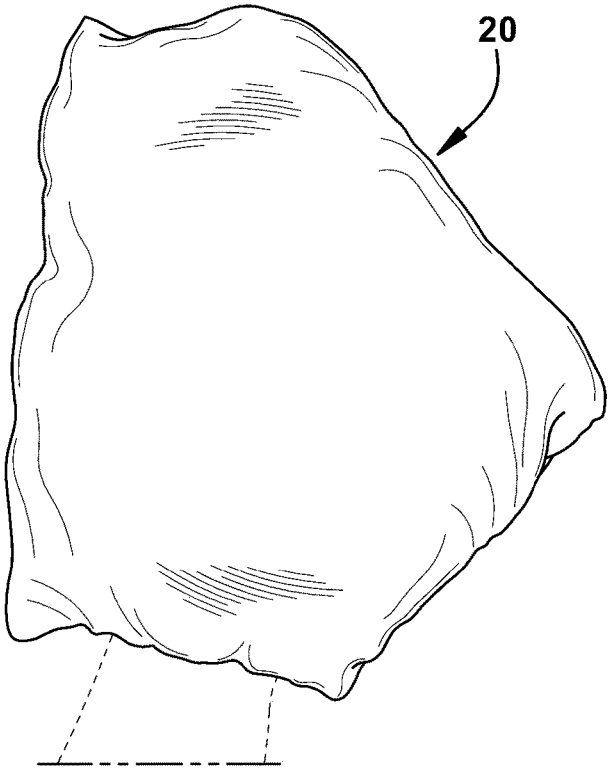
FIG. 15 shows a top view of the pillow or "puff" for stuffing into a volume formed within the head wrap for an up-style appearance.
Figure 16:
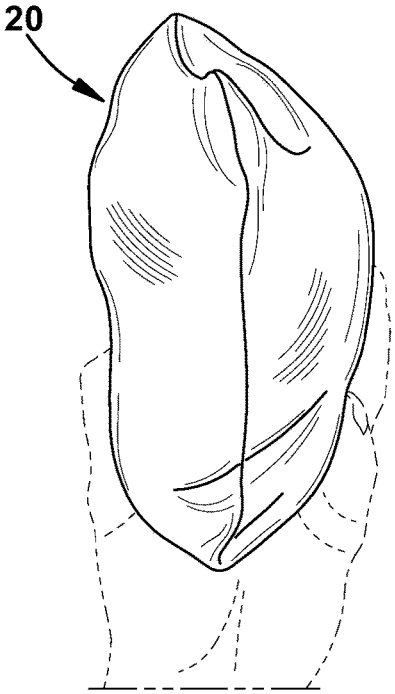
FIGS. 16 to 18 shows various side views of the pillow of FIG. 16.
Figure 17:
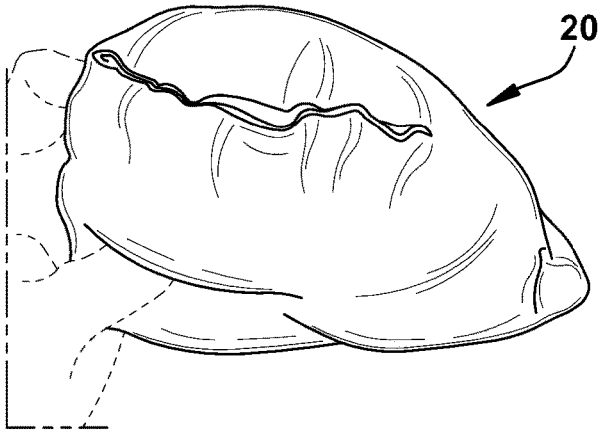
Figure 18:
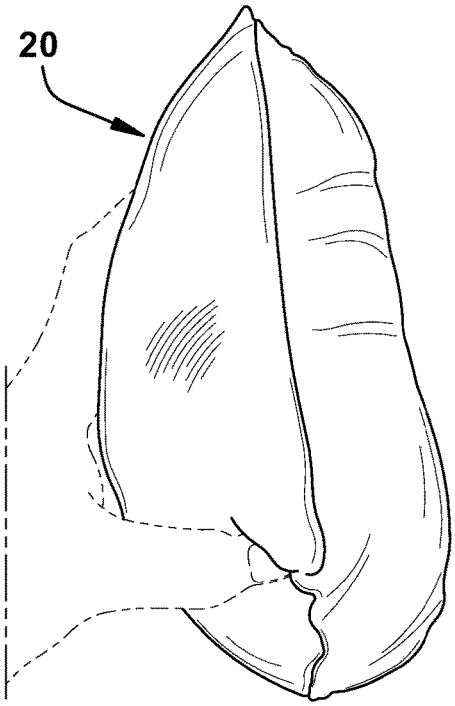

The wrap 10 may be worn at least 5 different ways. The full wrap style is shown in FIG. 7. The top bun (or turban with hair down) style is shown in FIG. 9. The back bun style is shown in FIG. 10. The headband style is shown in FIG. 8, and an additional style with the top bun stuffed with a pillow or puff 20 is also provided.

Figure 3:
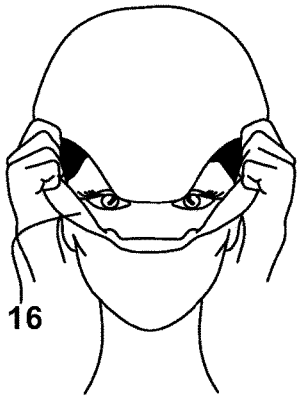
Figure 4:
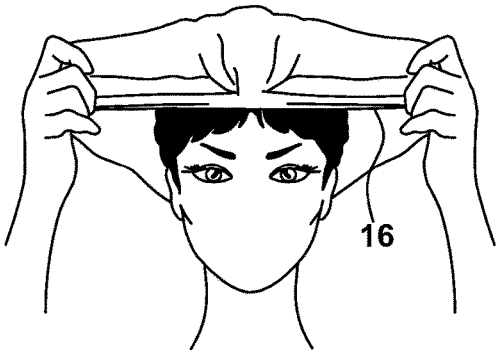
Figure 5:
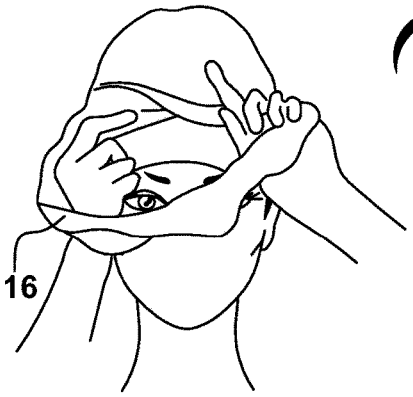
Figure 6:
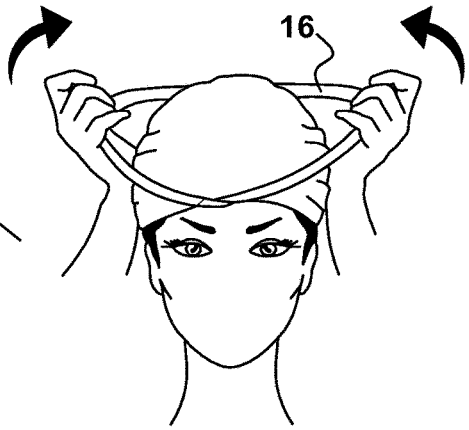

By sewing the corners 12, 13 as shown in FIG. 1, the head wrap 10 may be easily tied, or manipulated by the user, to convert into the desired covering for a user's head H. The steps: First, the head wrap 10 is put on top of the head H, as in FIG. 3. Second, the head wrap is stretched around the head H, as shown in FIGS. 4 to 6. Finally, the head wrap is tucked or folded according to the style the user would like to wear.

The head wrap 10 is an irregular pentagon, where the length of the 2 longest equal sides is 30 to 36 inches or smaller. The 2 opposite right angle corners are overlapped and sewn or secured together 14, as shown in FIG. 1, to form a strap 16, and resulting in the irregular pentagon forming a tube shape with open ends. The tube shape are pulled over the user's head H, with the strap 16 crisscrossed in the front. The strap 16 is next pulled behind the head H to secure the wrap 10. The remaining fabric of the wrap may then be twisted and tucked according to the type of style the user desires.

In the gripping or back elastic embodiment, shown in FIGS. 11 to 14, the grip strip of polymer gripping material 18, or band with sewn in elastic material 18, is worn on the back of the head H near the neck of the wearer. The elastic band or grip strip 18 enables less slippage or secure positioning of the wrap on the head. It also provides a clean appearance of the wrap at the back of the head of the wearer.

Another style of wearing a head wrap 10 includes stuffing a fabric pillow 20 filled with stuffing material inside the wrap. The stuffing material may be a polyester fiber material, or any other appropriate lightweight stuffing material. As shown in FIGS. 15 to 18, the accessory "puff" or pillow 20, is stuffed within or inside the wrap. Where the user does not have the volume of hair of the type shown in FIG. 8B, to achieve the appearance of the styles shown in FIG. 9A or 9B, the puff or pillow 20 is used to "fill" the potentially empty space or volume formed within the wrap 10. By stuffing the puff 20 into the top of the wrap 10, an up-style appearance is able to be worn by the user. The pillow puff 20 may be provided as any shape, such as circular, oval, triangle, square, rectangle, pentagon, polygon, or irregular pentagon, etc. The puff 20 may be provided into any type of hair band or head wrap of any shape or style, such as into a bun style or top knot style described above. Although shown as entirely detached from the head wrap, the puff or pillow 20 may be sewn or pinned to the inside of the wrap 10 to avoid coming loose or falling out during wearing.

While the present head wrap 10 has been disclosed in the context of various aspects of presently preferred embodiments, it will be recognized that the invention may be arranged in a variety forms consistent with the following claims.

I claim:

1. An accessory volume filling pillow of fabric material within a head and hair wrap of a fabric material, the head and hair wrap having the shape of an irregular pentagon having two opposite corners with 90 degree angles, wherein the two opposite 90 degree angle corners are overlapped and sewn together to form a tube shape with open ends, wherein the accessory volume filling pillow is a separate sewn fabric outer material filled with stuffing material, and the accessory volume filling pillow fills a volume formed within the head and hair wrap to enable an up-style appearance when wearing the head and hair wrap.

2. The accessory volume filling pillow within the head and hair wrap of claim 1, wherein the stuffing material is polyester fiber material.

3. The accessory volume filling pillow within the head and hair wrap of claim 1, wherein the accessory volume filling pillow has an external outline having the shape of a circle, oval, triangle, square, rectangle, pentagon, or irregular pentagon.

4. An accessory volume filling pillow of fabric material within a head and hair wrap of a stretchy fabric material, the head and hair wrap having the shape of an irregular pentagon having two opposite corners with 90 degree angles, and one corner with a 45 degree angle, wherein the two opposite 90 degree angle corners are overlapped and sewn together to form a tube shape with open ends, and wherein the accessory volume filling pillow is a separate sewn fabric outer material filled with stuffing material, and fills a volume formed within the head and hair wrap to enable an up-style appearance when wearing the head and hair wrap.

5. The accessory volume filling pillow within the head and hair wrap of claim 4, wherein the stuffing material is polyester fiber material.

6. The accessory volume filling pillow within the head and hair wrap of claim 4, wherein the accessory volume filling pillow has an external outline having the shape of a circle, oval, triangle, square, rectangle, pentagon, or irregular pentagon.

7. The accessory volume filling pillow within the head and hair wrap of claim 4, wherein the accessory volume filling pillow is attached by either sewing or pinning to the inside of the head and hair wrap.

* * * * *